US005121143A

United States Patent [19]

Hayamizu

[11] Patent Number: 5,121,143

[45] Date of Patent: Jun. 9, 1992

[54] INK PRINTING HEAD WITH VARIABLE-SIZE HEAT ELEMENTS

[75] Inventor: Mamoru Hayamizu, Tokyo, Japan

[73] Assignees: Graphtec Corp.; Soartec Corp., both of Tokyo, Japan

[21] Appl. No.: 562,335

[22] Filed: Aug. 3, 1990

Related U.S. Application Data

[63] Continuation of Ser. No. 244,821, Sep. 14, 1988, abandoned.

[51] Int. Cl.[5] ..... B41J 2/05

[52] U.S. Cl. ..... 346/140 R

[58] Field of Search ..... 346/140

[56] References Cited

U.S. PATENT DOCUMENTS

| | | | |
|---|---|---|---|
| 4,251,824 | 2/1981 | Hara | 346/140 |
| 4,380,771 | 4/1983 | Takatori | 346/140 |
| 4,558,330 | 12/1985 | Iizuka | 346/76 PH |
| 4,559,542 | 12/1985 | Mita | 346/76 PH |
| 4,631,555 | 12/1986 | Ikeda | 346/140 |
| 4,731,621 | 3/1988 | Hayamizu | 346/140 |
| 4,746,935 | 5/1988 | Allen | 346/140 R |
| 4,803,499 | 2/1989 | Hayamizu | 346/140 |
| 4,965,594 | 10/1990 | Komuro | 346/140 |

*Primary Examiner*—Joseph W. Hartary
*Attorney, Agent, or Firm*—Cislo & Thomas

[57] ABSTRACT

This invention relates to an ink jet printing head comprising in combination: a thermal head member having at least one thermal element consisting of a plurality of thermal dot elements, a guide member having ink-supplied grooves contacting the thermal elements and being moved reciprocatingly, and a plurality of electrodes of different widths connected to each thermal element, whereby different-sized heated portions of the thermal element are obtainable, and it is possible to vary the amount of ink jetted in one dot. For a ratio of 1:3 for the widths of the electrodes (corresponding to the widths of the heated portions) in one dot, 16 printing density levels (16×4) can be obtained by printing four times for one dot. By combining four dots it is possible to obtain 64 printing density levels (16×4). The thermal dot elements can be arranged in either a zigzag pattern or in a continuous straight form.

3 Claims, 3 Drawing Sheets

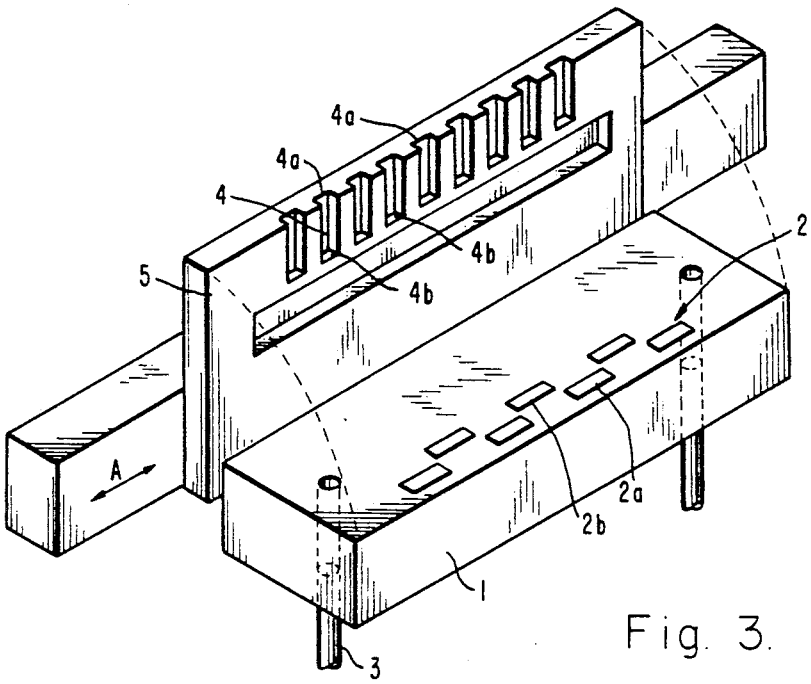
Fig. 3.
Fig. 4.
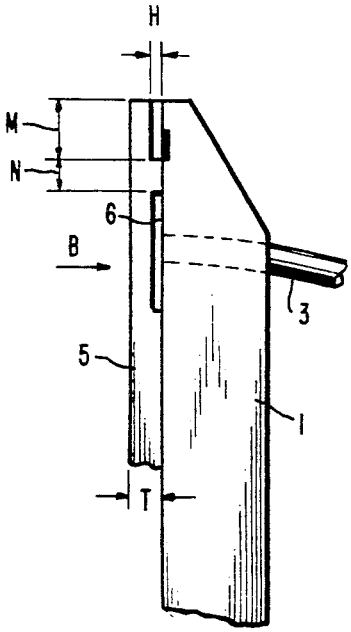
Fig. 7.
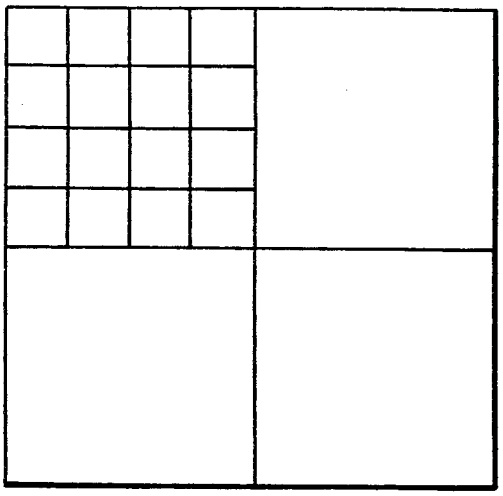

INK PRINTING HEAD WITH VARIABLE-SIZE HEAT ELEMENTS

Cross Reference to Related Application

This application is a continuation of abandoned application Ser. No. 07/244,821 filed Sep. 14, 1988 by the same applicant as for the present application.

BACKGROUND OF THE INVENTION

1. Field of the Invention

This invention relates to an ink jet printing head for a color printer with which it is possible to obtain a large range of print densities.

2. Description of the Related Art

Examples of conventional ink jet printing heads are provided in U.S. Pat. Nos. 4,490,728, 4,317,124, and 4,611,219. In these patents the printing head includes a stationary nozzle and a stationary thermal element having a plurality of thermal dots each of which has the same dimensions.

Ink is expelled from the nozzle in a jet by bubble pressure created by heating of the ink by the thermal dot element while the nozzle and thermal dot element are in stationary contact.

There are problems associated with the conventional type of construction described in the above patents:

With a one-to-one correspondence between a nozzle and a thermal dot, an ink stoppage in any one nozzle results in no ink jet from that nozzle, and a misprint occurs in the form of a white spot on the paper in front of the nozzle.

Furthermore, if the bubble remains in the nozzle and no ink reaches the thermal dot element due to an ink stoppage in the nozzle, there is a possibility of damage of the thermal dot element.

Also, for a 1:1 correspondence between nozzles and thermal dot elements, it is very difficult to make a nozzle assembly having many nozzles; therefore, it is difficult to obtain a high-density printing condition for full color printing with this type of construction. Conventionally, only simple color printing is obtained with a 1:1 ratio between nozzles and thermal dot elements.

SUMMARY OF THE INVENTION

It is therefore a principal object of the present invention to provide an ink jet printing head comprising in combination: a thermal head member having at least one thermal element consisting of a plurality of thermal dot elements, a guide member contacting the thermal head and having a plurality of grooves and being moved reciprocatingly, an ink supplying means for supplying ink into said grooves, and a plurality of electrodes of different widths connected to each thermal element, whereby different widths of heated portions of the thermal element are obtainable.

In accordance with the invention, by employing different widths of electrodes in an ink jet printing head, it is possible to vary the amount of ink jetted in one dot. For example for a ratio of 1:3 for the widths X and Y of the electrodes (corresponding to the widths of the heated portions) in one dot, 16 printing density levels ($16\times4$) can be obtained by printing four times for one dot. By combining four dots it is possible to obtain 64 printing density levels ($16\times4$). Furthermore, it would be possible to obtain 64 printing density levels ($8\times8$) for one dot by printing eight times and utilizing a ratio of electrode widths X:Y of 1:7.

BRIEF DESCRIPTION OF THE DRAWINGS

FIG. 3 is an exploded perspective view of another embodiment of the ink jet printing head of the present invention;

FIG. 4 is a fragmentary side elevational view of the ink jet printing head of FIG. 3;

FIG. 7 is a plan view of a printed pattern produced in accordance with the present invention.

DESCRIPTION OF THE PREFERRED EMBODIMENTS

Referring to the figures of drawings, a preferred embodiment and alternative embodiments of the present invention will now be described.

Figure 1:
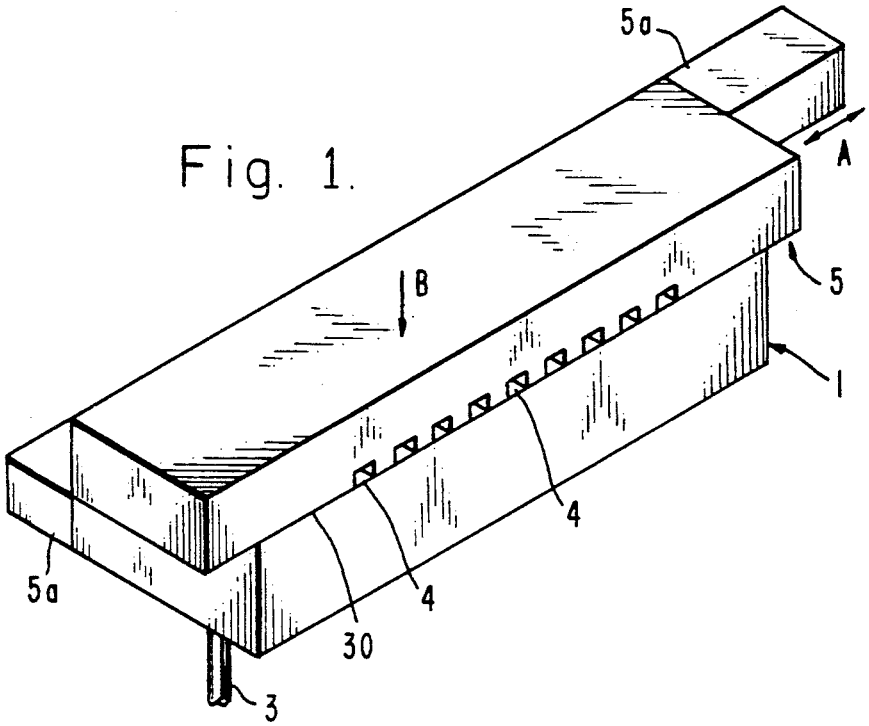
FIG. 1 is a perspective view of the ink jet printing head of the present invention.
Figure 2:
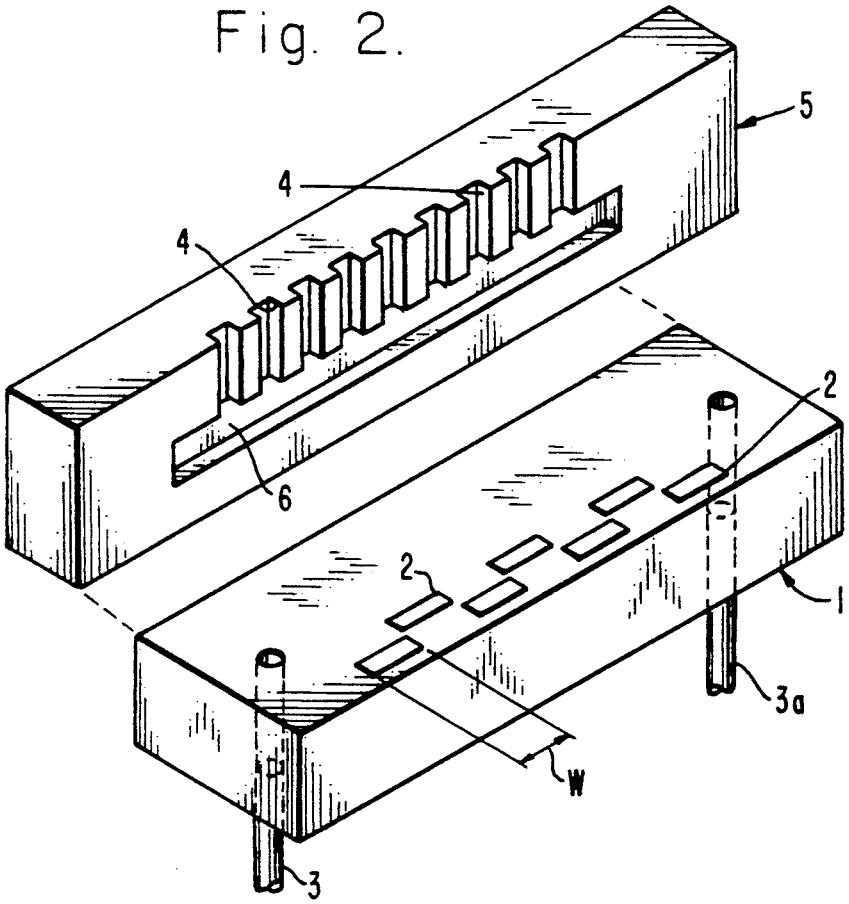
FIG. 2 is an exploded perspective view of the ink jet printing head of FIG. 1.

FIGS. 1 and 2 show the basic construction of an ink jet printing head comprising a thermal head 1 having at least one thermal element consisting of a plurality of thermal dot elements 2 and an ink-supplying tube 3 (shown partially in phantom) which is connected to an external ink tank (not shown). Tube 3 is mounted on thermal head 1. Another ink tube 3*a* (shown partially in phantom) may also be used. A guide member 5 has a plurality of grooves 4 which form a plurality of ink nozzles. Guide member 5 is slidably mounted on a bar 5*a* which moves reciprocatingly along a path indicated by A in FIG. 1. The bar 5*a* and the guide member 5 are positioned at a point marked by the arrow labeled B in FIG. 1. The number of grooves 4 does not necessarily correspond to the number of thermal dot elements 2.

Each of the grooves 4 need not completely correspond directly to each of the thermal dot elements 2. There is no one-to-one correspondence. A space exists between each of the grooves 4. If, for example, the width of the space is 0.03 mm and the width of each of the thermal dot elements 2 is 0.08 mm, then there is a 3:1 correspondence of grooves 4 to thermal dot elements 2. A recess 6 in guide member 5 forms an interior volume connected to the plurality of grooves 4 which acts as a means of gathering ink. The ink-gathering volume formed by recess 6 is connected with ink-supplying tube 3 and also communicates with the grooves 4 by a very small passageway 30 shown in phantom outline in FIG. 2.

FIGS. 3 and 4 show another embodiment of the present invention in which ink-gathering volume 6 is independent from grooves 4 and positioned a distance n away from the beginning of a length m of groove 4. Guide member 5 can be held tightly in contact with thermal head 1 by a resilient member (not shown). The same principle can be applied in the case of the preferred embodiment shown in FIGS. 1 and 2. Referring to FIG. 4, the locations and measurements of various parts of the ink jet head can be given by way of example as follows: h is 0.005–0.1 mm, m is 0.02–0.2 mm, n is 0.01–0.5 mm, and t is 0.04–0.2 mm. By further way of example, a driving frequency for reciprocating motion of guide member 5 in the directions indicated by the arrow marked A is about 0.1–5.0 kHz.

The thermal dot elements 2a and 2b experience vibration during the reciprocating movement of guide member 5. Guide member 5 also releases a great amount of fluid pressure when ink is jetted therefrom, causing a pumping action on the ink gathering volume 6 to transfer ink to the grooves 4. This pumping action creates an ink lather, whereby an effective pumping operation is maintained. This type of operation is attained by the construction shown in FIGS. 1 and 2.

Figure 5:
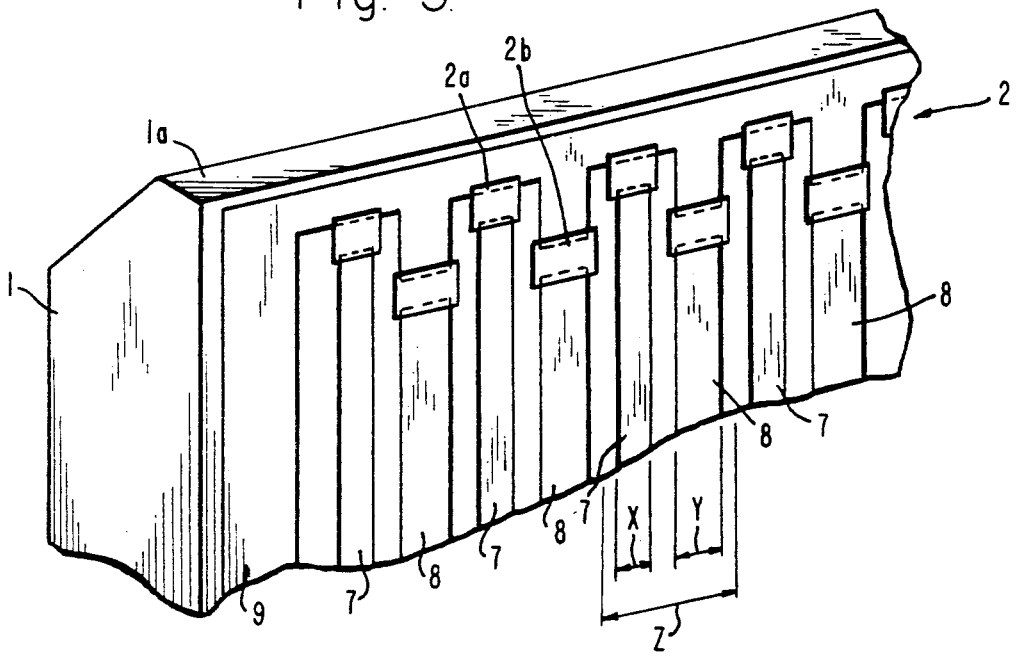
FIG. 5 is an enlarged perspective view of part of the thermal head.

The construction of thermal head 2 is shown in detail in FIG. 5. Thermal dot elements 2a and 2b are formed at different heights in a zigzag pattern on one side face of thermal head 1. A common electrode 9 is connected to one side portion of thermal element 2 along the length thereof, and individual electrodes 7 and 8 are connected to another side portion of thermal element 2. The width of electrode 8 is three times that of electrode 7, and a plurality of heated portions of thermal element 2 are independently formed when a drive signal pulse is applied to the thermal element 2 through electrodes 7 and 8.

When the widths X and Y of electrodes 7 and 8, respectively, are set so that $X<Y$ as shown in FIG. 5, the width of the heated portion of thermal element 2 can be varied, thereby allowing a variable amount of ink to be jetted. The dot defined by the width Z including the combined widths X and Y of the electrodes 7 and 8 has a ratio of X:Y of 1:3.

Figure 6:
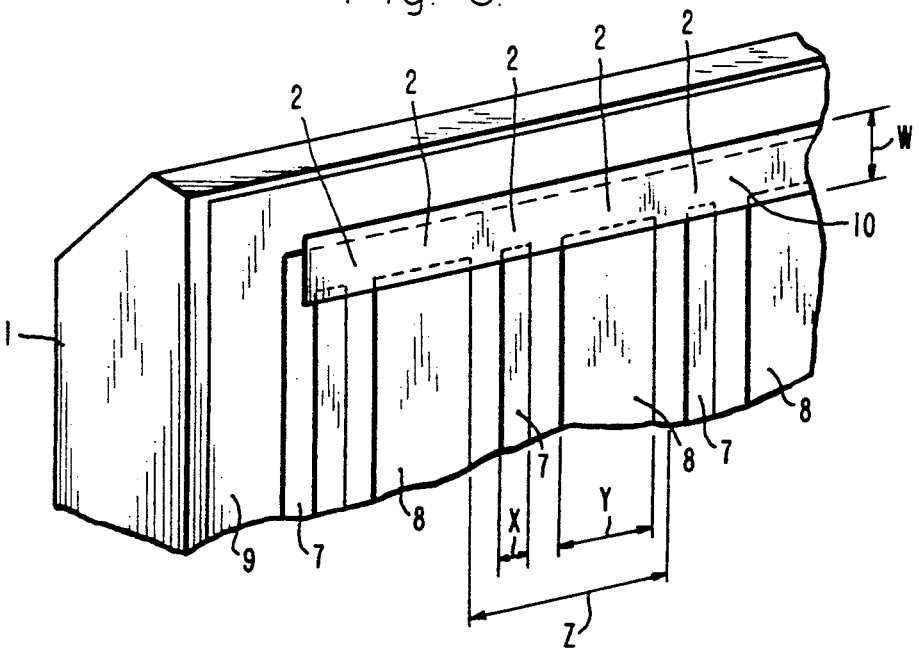
FIG. 6 is a fragmentary perspective view of another embodiment of the thermal head.

Another embodiment of the thermal head 1 is shown in FIG. 6. A thermal element 10 is formed by one continuous strip on the face of thermal head 1, with a common electrode 9 connected to one side of thermal element strip 10 along the length thereof and independent electrodes 7 and 8 having widths in the ratio of 1 to 3 are connected to another side of thermal element 10. A plurality of heated portions 2a and 2b are independently formed when a drive signal pulse is applied to thermal element 10 through electrodes 7 and 8.

The operation of the present invention will now be discussed. In the constructions shown in FIG. 1 or 4, ink is supplied to the ink-gathering volume 6 and the guide member 5 is reciprocatingly moved along the directions shown by the arrow marked A. Ink is continuously supplied to the plurality of grooves 4 through the very small passageway 30 between guide member 5 and thermal head 1.

When a certain driving pulse is applied to the plurality of thermal dot elements 2 from a control circuit (not shown), all of the ink in the grooves 4 is jetted or sprayed onto a printing surface (not shown) together with steam caused by bubbles created in grooves 4. Ink is supplied to the grooves 4 effectively by suction yielding a pumping action caused by the jetting operation when the ink is heated and sprayed out of the thermal head 1, by the sliding operation of the guide member 5, and by the pumping effect due to the vibration of the guide member 5.

Therefore, all of the ink in grooves 4 completely jets onto the printing surface together with steam. The device is able to control the jet of ink from the plurality of grooves 4 by applying heat energy above a certain operating level known in the art. For a ratio of X to Y in one dot Z of 1:3, it is possible to obtain 16 printing density levels ($4\times4$) by printing four times corresponding to the one dot Z. By combining four dots of size Z, it is possible to obtain 64 printing density levels ($16\times4$).

Furthermore, it is possible to obtain 64 printing density levels ($8\times8$) in one dot Z by printing eight times to the one dot Z with a ratio of X to Y of 1:7. In the case of the construction depicted in FIGS. 5 and 6, it is possible easily to set a minimum unit of tone output by varying the position of the thermal dot element 2 being electrically heated.

FIG. 7 illustrates the possibility of printing with 64 printing density levels ($16\times4$) by combining four dots of size Z each having 16 density levels per one dot Z.

According to present manufacturing techniques for a thermal head, it is possible to make 6 to 12 dots per millimeter, whereby full-color printing is easily obtained.

In accordance with the present invention, color printing with a range of tones is easily obtained by preferably setting a ratio of widths of electrodes located in one dot, since the widths of individual electrodes connected to the thermal dot element are different from each other.

Furthermore, it is possible to eliminate printing errors caused by ink stoppage since a plurality of grooves corresponds to one thermal dot element (in this embodiment in which a common electrode and a plurality of individual electrodes correspond to one dot of size Z).

It should be understood that the invention in its broader aspects is not limited to the specific embodiments shown and described herein, but departures may be made therefrom within the scope of the appended claims without departing from the principles of the invention and without sacrificing its chief advantages. All such modifications and changes will make themselves apparent to those of ordinary skill in the art and all such changes and modifications are intended to be covered by the appended claims.

What is claimed is:

1. An ink jet printing head for varying the amount of ink jetted therefrom, comprising:

a thermal head (1) including a plurality of heated regions (2) having differing dimensions, said plurality of heated regions (2) being in spaced relationship each from the other to form a linear array extending in a first direction;

a guide member (5) contacting said thermal head (1) and reciprocatingly movable in said first direction by a drive means, said guide member (5) having a plurality of grooves (4) for each said heated region (2), each said groove (4) having the same transverse cross-sectional area and extending in a second direction, said second direction being substantially orthogonal to said first direction;

an ink-supplying means (3,6) for supplying ink into each said groove (4); and a plurality of electrodes (7,9) disposed on said thermal head (1) defining aid heated regions therebetween, said electrodes (7,9 and 8,9) having differing widths to correspond to said differing dimensions of said heated regions (2), whereby said amount of ink jetted from said thermal head is varied responsive to which of said electrodes are supplied with electrical energy, and wherein if one of said grooves associated with a given one of said heated regions becomes clogged, another of said plurality of grooves corresponding to said given heated region allows ink to flow, thus preventing a misprint.

2. An ink jet printing head as claimed in claim 1 wherein said plurality of heated regions (2) are disosed in a zigzag pttern of staggered positions on a surface of said thermal head (1), and wherein it is possible to vary a jetted amount of ink because said heated regions are disposed in different positions along a length direction of said grooves.

3. An ink jet printing head as claimed in claim 1 wherein said each of said plurality of heated regions are formed in a discrete region of a singular thermal element (10) disposed on a surface of said thermal head (1).

* * * * *